United States Patent [19]

Schuster et al.

[11] Patent Number: 4,574,967

[45] Date of Patent: Mar. 11, 1986

[54] SEALING CAP FOR A SAFETY CONTAINER

[75] Inventors: Wilhelm Schuster; Jürgen Stahl; Lüdwig Scondo, all of Frankfurt am Main, Fed. Rep. of Germany

[73] Assignee: AHK Alkohol Handelskontor GmbH & Co. KG, Lippstadt, Fed. Rep. of Germany

[21] Appl. No.: 658,826

[22] Filed: Oct. 9, 1984

[30] Foreign Application Priority Data

Oct. 12, 1983 [DE] Fed. Rep. of Germany ..... 3337060

[51] Int. Cl.[4] ..... B65D 41/08

[52] U.S. Cl. ..... 215/276

[58] Field of Search ..... 215/274, 276; 220/319

[56] References Cited

U.S. PATENT DOCUMENTS 3,905,509 9/1975 Markowitz ..... 215/274 X 4,089,433 5/1978 Jonsson ..... 215/274 X 4,345,691 8/1982 Burke ..... 215/276 X

*Primary Examiner*—Donald F. Norton

*Attorney, Agent, or Firm*—Fidelman, Wolffe & Waldron

[57] ABSTRACT

A sealing cap for a container provided with a safety valve is described, this sealing cap consisting of a bottom part which can be screwed onto the container neck and firmly locked there and of a top part which can be screwed onto the bottom part. The bottom part serves to seal absolutely the container neck provided with the safety valve, by compressing, in a moisture-tight manner, the joint between the edge of the container neck and a molding forming the valve support. The bottom part, fixed in position by retaining tabs and detent lugs, and capable of being loosened only by force, remains fixedly connected to the container during use. The top part can be unscrewed.

4 Claims, 8 Drawing Figures

SEALING CAP FOR A SAFETY CONTAINER

Figure 1:
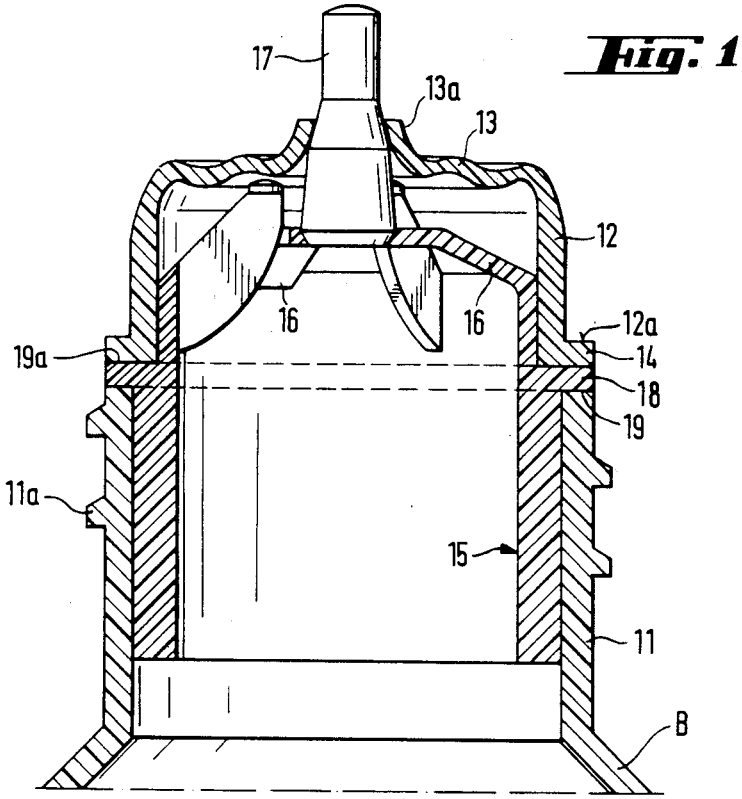

The invention relates to a sealing cap, having a screw thread, for a container provided with a safety valve, from which container, in particular, readily flammable liquids are poured, the safety valve of this container consisting of a control valve which is supported by a cylindrical molding, controlled by a membrane and actuated by reducing the interior space of the container, the membrane of this control valve having a central recess limited by a gasket through which a valve cone is inserted, the gasket of the membrane bearing on this valve cone and being itself molded onto a cylindrical membrane carrier which encloses the upper edge region of the cylindrical section of the molding of the conical valve and rests, by means of a flange which projects radially outwards, on a collar of the molding, which collar projects radially outwards.

A safety container of this kind has been disclosed in German Offenlegungsschrift No. 2,933,134. The design of the safety valve is such that it opens when pressure is applied to the elastic container wall, and closes immediately and without delay when the pressure is released. This safety valve operates satisfactorily. It has however been found that the joint between the edge of the container neck and the molding forming the valve carrier has not always been completely tight, and that some of the liquid has escaped from the interior of the container at this point in some circumstances. It is impossible in practice to weld this joint, as this would only be practical once the container had been filled. However, the readily flammable contents of the said container prohibit such welding.

It the object of the present invention to provide a sealing cap which ensures an absolutely leak-free tightness of this joint, both when the container is not in use and when it is in use.

This object is achieved by means of a sealing cap comprising a bottom part which can be screwed onto the container neck and a top part which can be screwed onto the bottom part, the bottom part having an inward-projecting step above the internal thread which can be screwed onto the container neck, this step resting firmly on the upper side of the flange of the membrane support when the sealing cap is screwed on, and detent tabs furthermore being molded onto the inner wall of the free end of the bottom part and interacting with retaining lugs arranged on the outer periphery of the container neck.

Advantageous further developments of the sealing cap are characterized in the sub-claims.

A two-part sealing cap of this type ensures the desired leak-free connection at the joint between the free edge of the container neck and the support part, seated thereon, of the safety valve. Apart from the fact that the bottom part of the sealing cap always remains on the container neck and encloses this joint, it also presses tightly together the two parts which rest one on the other. Moreover, the locking on the container neck both increases the stable seating and prevents ready loosening of the bottom part, which in fact can be removed only with extreme force. The top part of the sealing cap is a conventional screw lid which is screwed onto the bottom part. Advantageously, it is provided with a socket which serves as an additional securing device for the gasket of the membrane of the safety valve.

Additionally, however, this embodiment of the sealing cap offers the further advantage of particular safety in that the seating of the bottom part of the cap can be loosened only by force. This prevents the safety valve blocked by this bottom part of the cap from being removed from the container neck, by users not aurthorized to do this, after emptying of the container, and the container being refilled for further use. A safety valve which is removed and then re-used involves the danger that this valve may be damaged and/or that it no longer is, or can be, used in a sealing manner. This would be irresponsible in any event, but particularly so if the container were to be refilled with particularly hazardous, readily flammable liquids belonging to Class A1.

Hence, the sealing cap according to the invention not only ensures the perfect tightness of the container but also achieves the object of providing additional security against unauthorized removal of the safety seal.

Figure 2A:
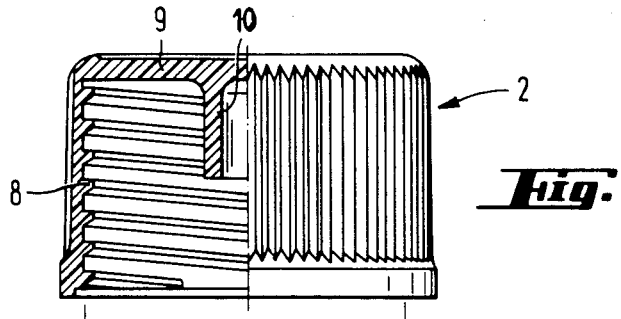
Figure 2B:
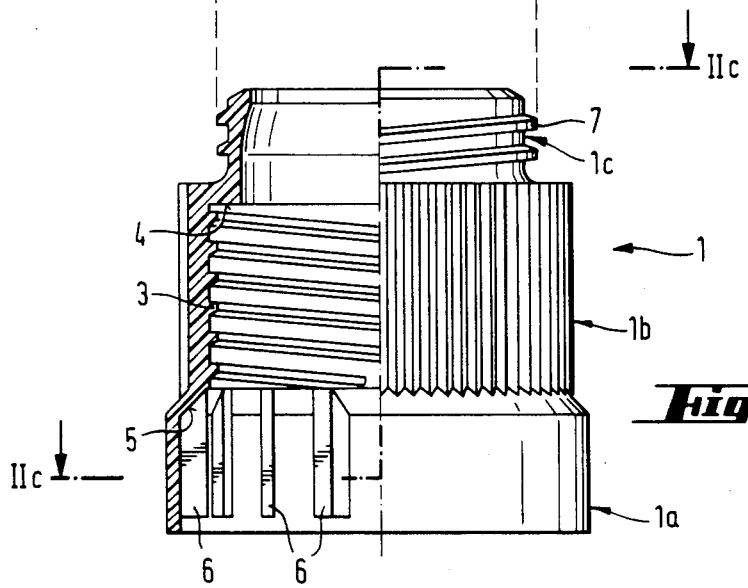
Figure 2C:
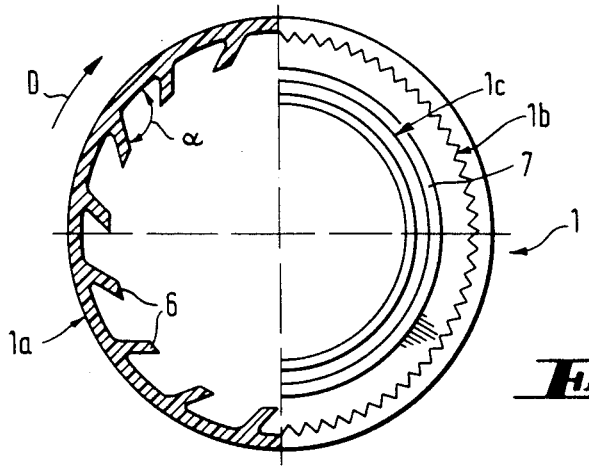

The sealing cap according to the invention is explained in detail with reference to an exemplary embodiment illustrated in the drawings, wherein:

FIG. 1 shows a view in longitudinal section of a safety valve inserted into a container neck;

FIG. 2*a* shows a lateral view, partly in section, of a top part of the sealing cap;

FIG. 2*b* shows a lateral view, partly in section, of a bottom part of the sealing cap;

FIG. 2*c* shows a top view, partly in section, of the bottom part according to FIG. 2*b;*

Figure 3A:
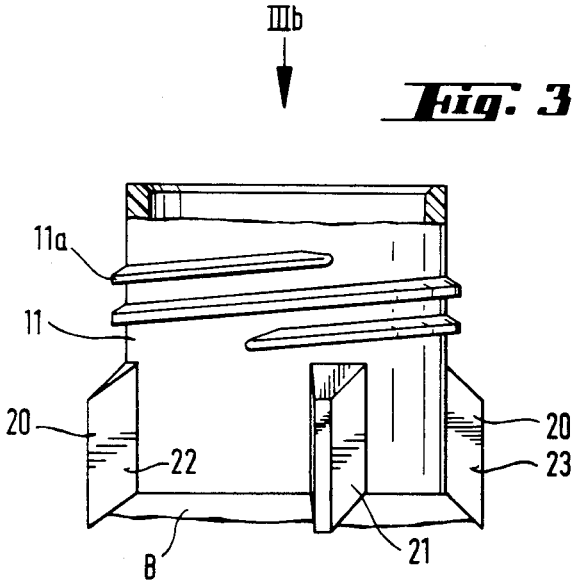
Figure 3B:
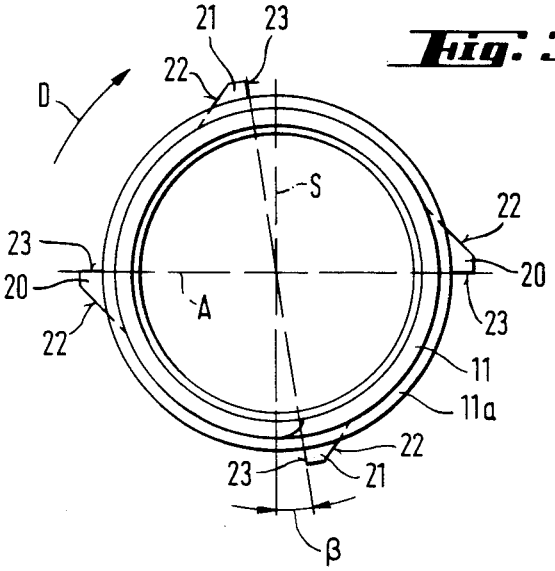

FIG. 3*a* shows a lateral view of a part of the container neck;

FIG. 3*b* shows a plane view of the container neck according to FIG. 3*a;*

Figure 4:
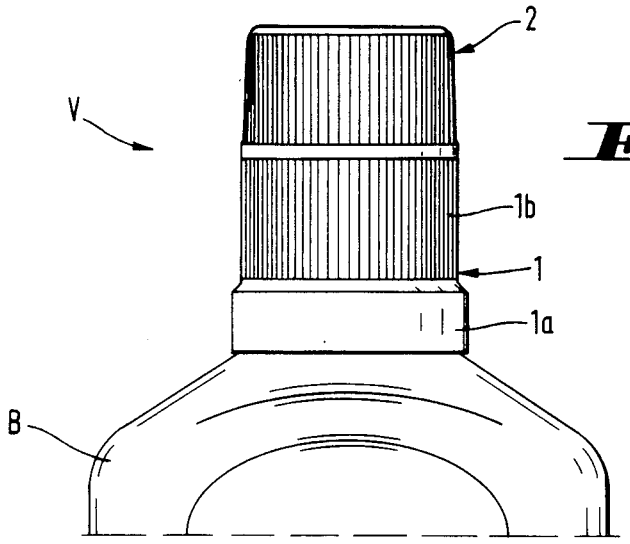
Figure 5:
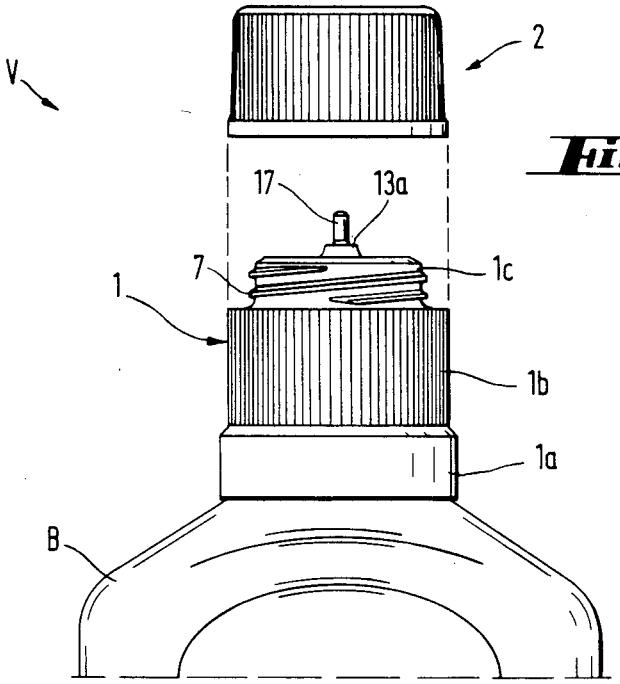

FIG. 4 shows a lateral view of a sealing cap placed onto the container neck; and FIG. 5 shows a view similar to FIG. 4 with the top part of the sealing cap removed.

For the purpose of readier understanding of the sealing cap V according to the invention, FIG. 1 shows a sectional view of the container neck 11 with a safety valve inserted. The said valve consists of a membrane support 12, to which is molded a membrane 13 with a gasket 13*a*. A valve cone 17 of the safety valve is inserted through the aperture in the membrane 13 limited by the gasket 13*a*, this valve cone 17 being supported by a partially cylindrical molding 15 which has elastically resilient support parts 16 molded thereon. A flange 14, which projects radially outwards, is provided at the free edge of the substantially cylindrical membrane support 12, opposite to the membrane 13. A collar 18, which projects radially outwards, is molded onto the upper region of the outside of the cylindrical molding 15 of the valve support, the flange 14 of the membrane support 12 resting on the upper side of this collar 18. The membrane 12 is advantageously connected to the molding 15 by means of a weld joint at this point of contact 19*a*. In this manner, the safety valve is an integral component which is inserted into the container neck 11. When this is done, the underside of the collar 18 of the molding 15 comes to rest on the upper side of the edge of the container neck 11. If this joint 19 thus formed is not satisfactorily tight, the liquid located in the container B, which as a rule is very mobile and has a relatively high vapor pressure, may leak. It is therefore necessary to seal this point. As already mentioned, however, this cannot be done due to the hazardous contents of the container.

The sealing cap V developed to ensure tightness consists of a bottom part 1 and a top part 2 (FIGS. 2*a* to 2*c*). The bottom part 1 is that piece of the sealing cap V which ensures tightness. Advantageously, it is subdivided into sections recognizable by steps, namely a bottom section 1*a*, a middle section 1*b* and a top section 1*c*. The middle section 1*b* is distinguishable from the top section 1*c* by an inward-drawn step 4, and has an internal thread 3 which is screwed onto the external thread 11*a* on the container neck 11. The step 4 then assumes an important function, as it is firmly pressed onto the upper side 12*a* of the flange 14 of the membrane support 12. It presses this flange 14 together with the collar 18 of the molding 15 against the top side of the free edge of the container neck 11, and seals the joint 19 completely tightly. The bottom section 1*a* of the bottom part 1 is offset from the middle section 1*b* by an outward-pointing step shoulder 5. In this bottom section 1*a* are provided detent tabs 6, which are molded onto the inner wall of this section. They preferably start from the step shoulder 5, and are obliquely positioned, so that they form an obtuse angle $\alpha$ with the inner wall of the bottom part 1 in the screwing-on direction of rotation of the latter (FIG. 2*c*).

These detent tabs 6 interact with retaining lugs 20—20, 21—21, which are arranged on the outer wall of the container neck 11 below the exterior thread 11*a* (FIGS. 3*a* and 3*b*). At least two retaining lugs 20—20 situated opposite one to the other, but preferably four retaining lugs 20—20 and 21—21, are provided. In a preferred embodiment, the retaining lugs of one opposed pair, for example the reaining lugs 21—21 (FIG. 3*b*), are arranged offset at an angle $\beta$ from the perpendicular S intersecting the axis A. An advantageous angle for this angle $\beta$ is 9° from the perpendicular S in each case. However, the retaining lugs 21—21, which are arranged offset, also lie in a straight line which passes through the central point of the aperture of the container neck 11. The other pair of retaining lugs 20—20 lies on the axis A.

The retaining lugs 20—20 and 21—21 have a gradually rising inclination 22 in the screwing-on direction of rotation D. When the bottom part 1 of the sealing cap V is screwed on, the obliquely positioned, slightly resilient detent tabs 6 slide over the inclinations 22 of the retaining lugs 20—20, 21—21 and slip over the highest point thereof, in order to latch against the substantially straight wall 23 of each retaining lug to lock the bottom part 1. In this manner the bottom part 1 is prevented from turning back. Due to the pair of retaining lugs 21—21, which are arranged offset, the screwing-up force is somewhat reduced and the return screw travel is shortened.

The screwed-on bottom part 1 of the sealing cap V always remains in position, irrespective of whether the container B is in use or not in use.

For use, only the top part 2 is unscrewed, this part being undone in the form of a small cap with internal thread 8 on a right-hand thread 7 (FIG. 2*b*) of the upper section 1*c* of the bottom part 1. Advantageously, a crylindrical socket 10 is molded on, pointing from the covering plate 9 of the top part 2 into the interior of the cap, and serving to press the gasket 13*a* onto the valve cone 17 during non-use of the container B. The top part 2 can readily be unscrewed without this resulting in movement of the bottom part 1, which always remains on the container neck 11.

In FIG. 4 a container B is indicated and a sealing cap V is screwed onto the container neck. The small cap forming the top part 2 is, in this case, advantageously so designed that its outer contour fits flush against the outer contour of the middle section 1*b* of the bottom part 1.

In FIG. 5, it is possible to see how the container neck or container with the screwed-on bottom part 1 appears when the top part 2 is unscrewed. The valve cone 17 with the gasket 13*a* projects from the free aperture of the top section 1*c* of the bottom part 1.

We claim:

1. A sealing cap particularly adapted for a container having a safety valve consisting of a conical valve supported by a cylindrical molding, controlled by a membrane and actuated by reducing the interior space of the interior of said container, the membrane having a central recess limited by a gasket through which a valve cone is inserted, said gasket bearing upon said valve cone and molded onto a cylindrical membrane carrier enclosing the upper edge region of the cylindrical section of the molding of the conical valve and resting by means of an outwardly projecting radial flange on an outwardly projecting radial collar of the molding of the valve support, said container further having an exterior thread situated on the neck thereof below the valve, and at least two retaining lugs situated on the neck thereof below said exterior threads, said sealing cap consisting of separable top and bottom members said bottom member having internal thread means interactable with the external thread means of said container; and inwardly projecting step above said internal thread means, said step situated to rest firmly on the upper side of the flange of the membrane support of the container; at least two detent tabs situated on the inner wall thereof and interactable with said retaining lugs; and external thread means interactable with internal thread means situated on said separable top member;

said separable top member being a cap having internal thread means interactable with said external thread means of said bottom member.

2. A sealing cap as defined by claim 1 wherein said bottom member has an outwardly projecting step shoulder below said internal thread means, said step shoulder delimiting a protruding bottom section of said bottom member, said bottom section having said detent tabs molded onto the inner wall thereof.

3. A sealing cap as defined by claim 2 wherein said detent tabs are arranged to start from said step shoulder of said bottom member, said tabs being obliquely positioned to include an obtuse angle and with the inner wall of said bottom member in the direction of screwing-on rotation.

4. A sealing cap as defined by claim 1 wherein said top member is further defined as having a socket member attached to and projecting downwards from the top thereof, said socket enclosing said gasket of said container when said safety cap is in the closed position.

* * * * *